US010869501B2

(12) United States Patent
Thorens et al.

(10) Patent No.: US 10,869,501 B2
(45) Date of Patent: Dec. 22, 2020

(54) METHOD OF MANUFACTURE FOR A HEATER ASSEMBLY FOR USE WITH A LIQUID FILLED CARTRIDGE

(71) Applicant: PHILIP MORRIS PRODUCTS S.A., Neuchatel (CH)

(72) Inventors: Michel Thorens, Moudon (CH); Alexis Louvet, Lausanne (CH); Yvan Degoumois, Colombier (CH); Flavien Dubief, Champagne (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 1141 days.

(21) Appl. No.: 14/776,227

(22) PCT Filed: Dec. 20, 2013

(86) PCT No.: PCT/EP2013/077651
§ 371 (c)(1),
(2) Date: Sep. 14, 2015

(87) PCT Pub. No.: WO2014/139610
PCT Pub. Date: Sep. 18, 2014

(65) Prior Publication Data

US 2016/0044962 A1 Feb. 18, 2016

(30) Foreign Application Priority Data

Mar. 15, 2013 (EP) ..... 13159555

(51) Int. Cl.
*A24F 47/00* (2020.01)
*H05B 3/58* (2006.01)

(52) U.S. Cl.
CPC ..... *A24F 47/008* (2013.01); *H05B 3/58* (2013.01); *H05B 2203/017* (2013.01)

(58) Field of Classification Search
CPC ..... A24F 47/008; A24F 47/00; A24F 47/002; A24F 47/004; H05B 3/58; H05B 3/748; H05B 6/1236
(Continued)

(56) References Cited

U.S. PATENT DOCUMENTS 5,484,086 A * 1/1996 Pu ..... A61L 9/037 222/187
6,598,607 B2 7/2003 Adiga et al.
(Continued)

FOREIGN PATENT DOCUMENTS

CN 102014677 A 4/2011
CN 202206878 U 5/2012
(Continued)

OTHER PUBLICATIONS

Combined Chinese Office Action and Search Report dated Feb. 28, 2017 in Application No. 201380074695.1 (with English language translation).
(Continued)

*Primary Examiner* — Justin C Dodson
(74) *Attorney, Agent, or Firm* — Oblon, McClelland, Maier & Neustadt, L.L.P.

(57) ABSTRACT

There is provided a method of manufacturing a heater assembly for an aerosol-generating system, including providing a flexible wick; coupling a rigid support element to the wick; assembling a heating element around the rigid support; and removing the rigid support. There is also provided a method of manufacturing a heater assembly for an aerosol-generating system, including providing a flexible wick; applying tension to the wick; assembling a heating element around the wick; and releasing the tension from the wick.

13 Claims, 7 Drawing Sheets

(58) Field of Classification Search
USPC ..... 392/394, 395, 396, 387, 403–406
See application file for complete search history.

(56) References Cited

U.S. PATENT DOCUMENTS

| | | | | |
|---|---|---|---|---|
| 6,963,053 | B2 * | 11/2005 | Lutz | H05B 3/50 219/534 |
| 7,509,035 | B2 * | 3/2009 | Ranish | H01L 21/67115 118/50.1 |
| 2003/0075188 | A1 * | 4/2003 | Adiga | A24F 47/004 131/185 |
| 2009/0255534 | A1 * | 10/2009 | Paterno | A61M 15/0028 128/203.21 |
| 2009/0272379 | A1 | 11/2009 | Thorens et al. | |
| 2011/0094523 | A1 * | 4/2011 | Thorens | A61M 11/042 131/194 |
| 2011/0155153 | A1 | 6/2011 | Thorens et al. | |
| 2011/0277761 | A1 * | 11/2011 | Terry | A24F 47/008 128/203.12 |
| 2012/0145169 | A1 | 6/2012 | Wu | |
| 2014/0157583 | A1 | 6/2014 | Ward et al. | |

FOREIGN PATENT DOCUMENTS

| | | | |
|---|---|---|---|
| CN | 102655773 | A | 9/2012 |
| CN | 102753047 | A | 10/2012 |
| CN | 102894485 | A | 1/2013 |
| EP | 2340729 | A1 | 7/2011 |
| EP | 2 460 424 | A1 | 6/2012 |
| JP | 2000-12199 | A | 1/2000 |
| JP | 2011-518567 | A | 6/2011 |
| KR | 20-2011-0010862 | | 11/2011 |
| WO | 2009/132793 | A1 | 11/2009 |
| WO | 2014/088889 | A1 | 6/2014 |
| WO | WO 2014/160055 | A1 | 10/2014 |

OTHER PUBLICATIONS

Combined Office Action and Search Report dated Mar. 10, 2017 in Taiwanese Patent Application No. 102149162 (with English language translation).
International Search Report and Written Opinion of the International Searching Authority dated Jun. 27, 2014 in PCT/EP2013/077651 filed Dec. 20, 2013.
Combined Office Action and Search Report dated Dec. 1, 2017 in Russian Patent Application No. 2015142666 (with English language translation) citing reference AA therein, 12 pages.
Japanese Office Action dated Oct. 10, 2017 in Patent Application No. 2015-561965 (with English Translation).
Argentina Office Action with English translation dated Sep. 28, 2019 in corresponding Argentine Patent Application No. 20130105092. Citing document AA therein (5 pages).
Extended European Search Report dated Jan. 23, 2020 in European Patent Application No. 19198155.4, citing document AO therein, 9 pages.
Korean Office Action dated Jul. 22, 2020 in correspanding Korean Patent Application No. 10-2015-7026091 (with English translation), citing document AO therein, 7 pages.

* cited by examiner

7C

METHOD OF MANUFACTURE FOR A HEATER ASSEMBLY FOR USE WITH A LIQUID FILLED CARTRIDGE

The present invention relates to a method of manufacturing a heater assembly suitable for use in an aerosol-generating system. In particular, the present invention relates to a method of manufacturing a heater assembly including a heater engaged with a capillary wick.

Electrically heated smoking systems that are handheld and operate by heating a liquid aerosol-forming substrate in a capillary wick are known in the art. For example, WO2009/132793 describes an electrically heated smoking system comprising a shell and a replaceable mouthpiece. The shell comprises an electric power supply and electric circuitry. The mouthpiece comprises a liquid storage portion and a capillary wick having a first end and a second end. The first end of the wick extends into the liquid storage portion for contact with liquid therein. The mouthpiece also comprises a heating element for heating the second end of the capillary wick, an air outlet, and an aerosol-forming chamber between the second end of the capillary wick and the air outlet. When the shell and mouthpiece are engaged, the heating element is in electrical connection with the power supply via the circuitry, and a flow route for air is defined from at least one air inlet to the air outlet via the aerosol-forming chamber. In use, liquid is transferred from the liquid storage portion towards the heating element by capillary action in the wick. Liquid at the second and of the capillary wick is vaporised by the heating element. The supersaturated vapour created, is mixed and carried in the air flow from the at least one air inlet to the aerosol-forming chamber. In the aerosol-forming chamber, the vapour condenses to form an aerosol, which is carried towards the air outlet into the mouth of a user.

While this type of system has advantages, there are challenges in the manufacture of the mouthpiece and in particular with the assembly of the heating element with the capillary wick. It would be desirable to be able to provide a method for manufacturing such a heater assembly that is robust and inexpensive, suitable for mass manufacturing on a production line.

In a first aspect, there is provided a method of manufacturing a heater assembly for an aerosol-generating system, comprising:

providing a flexible wick coupling a rigid support element to the wick;

assembling a heating element around the rigid support; and removing the rigid support.

The rigid support may be coupled to the wick by inserting the rigid support element within the wick. Alternatively, the rigid support element may be coupled to an exterior of the wick. In particular, the rigid support element may be a tubular element into which the wick is inserted.

In the case of the rigid support element being a tubular element, the heating element may first be assembled around the tubular element, the wick subsequently inserted into the tubular element and the tubular element then removed from both the heating element and the wick. The wick and tubular element may be dimensioned such that when the wick is released by the tubular element, the heating element contacts and retains the wick.

The heating element may be a coil of electrically resistive wire. Alternatively, the heating element may be formed by stamping or etching a sheet blank that can be subsequently wrapped around a wick. In a preferred embodiment, the at least one heating element is a coil of electrically resistive wire. The pitch of the coil is preferably between 0.5 and 1.5 mm, and most preferably approximately 1.5 mm. The pitch of the coil means the spacing between adjacent turns of the coil. The coil may advantageously comprise fewer than six turns, and preferably has fewer than five turns. The electrically resistive wire advantageously has a diameter of between 0.10 and 0.15 mm, and preferably of approximately 0.125 mm. The electrically resistive wire is preferably formed of 904 or 301 stainless steel.

The heater assembly may include a liquid storage portion containing or adapted to contain a liquid aerosol-forming substrate. The wick may be assembled to the liquid storage portion before or after removal of the rigid support. The wick may also be assembled to the liquid storage portion before or after the heating element is assembled around the rigid support.

The liquid storage portion may comprise two portions. The two portions may be assembled together after one of the portions has been filled with the liquid aerosol-forming substrate. The two portions may be assembled together using any suitable method, including welding, gluing and mechanical locking. The two portions may comprise a main portion and a cap portion.

In one embodiment, the wick may be positioned through an opening in a cap portion of the liquid storage portion when the heater assembly has been assembled. The wick may advantageously be fixed to the cap portion before the rigid support element is removed. The cap portion may be assembled from a plurality of pieces that are joined together around the wick. The plurality of pieces may be joined together using any suitable method, including welding, gluing and mechanical locking. The cap portion may subsequently be assembled to a main portion of the liquid storage portion. In one embodiment, the cap portion is formed from two pieces that are joined together around the wick.

In another embodiment, the wick extends through an aperture in a main portion. The wick may advantageously be fixed to the main portion before the rigid support element is removed. The main portion may be assembled from a plurality of pieces that are joined together around the wick. The main portion may subsequently be assembled to a cap portion or a plug portion. In one embodiment, the main portion is formed from two portions that are joined together around the wick.

The heater assembly may further include one or more electrical contact elements that are fixed to heating element to provide, in use, an electrical connection between the heating element and external circuitry. The one or more electrical contact elements may each take the form of an electrically conductive blade. The electrical contact element or elements may be mounted to the liquid storage portion.

The electrical contact elements may be mounted to the liquid storage portion before being connected to the heating element. The electrical contact elements may be mounted to a portion of the liquid storage portion before that portion is fixed relative to the wick.

The heater assembly may comprise a first electrical contact element and a second electrical contact element, the first electrical contact element contacting an opposite end of the heating element to the second electrical contact element. The first electrical contact element may be fixed to a first piece of the cap portion or main portion and the second electrical contact element may be fixed to a second piece of the cap portion or main portion before the first and second pieces of the cap portion or main portion are fixed relative to the wick.

The electrical contact element or elements may be brought into contact with the heating element before the rigid support element is removed. This rigid support may be advantageous in a pressing or crimping operation to press the electrical contact portion into contact with the heating element. Alternatively, or in addition, the electrical contact element or elements may be welded to the heating element. The welding of the electrical contact element or elements may take place before removing the rigid support element. Alternatively, or in addition, clamping or gluing of the electrical contact element or elements may be used before removing the rigid support element. Any other suitable means for attachment for the electrical contact portions to the heater and to the liquid storage portion may be used, including gluing, soldering and mechanical interlocking.

The electrical contact element or elements may be mounted to the liquid storage portion or a part of the liquid storage portion before or after the wick is fixed to the liquid storage portion or a portion of the liquid storage portion.

In embodiments in which the heating element is a coil of electrically resistive wire, the electrically resistive wire may be wound around the rigid support element. The resistive wire may subsequently be pressed or crimped against the wick or rigid support element in a pressing or crimping operation. Electrical contact elements may be used to perform the pressing or crimping operation. The pressing or crimping operation may be performed before or after the removal of the rigid support element but is advantageously performed before the rigid support element is removed.

The winding of the electrically resistive wire around the rigid support element may be performed by rotation of the rigid support element relative to a supply of tensioned electrically resistive wire. Alternatively, the winding of the electrically resistive wire around the rigid support element may be performed by rotation of a flyer relative to the rigid support element, a supply of tensioned electrically resistive wire being supplied to the flyer.

The heater assembly may further comprise a cover portion provided over the wick and heating element and defining a chamber surrounding the heating element. The cover portion may be assembled to the liquid storage portion as a final stage in the assembly process and may be fixed to the liquid storage portion by any suitable means, such as welding, gluing or a mechanical locking arrangement.

In a second aspect, there is provided a method of manufacturing a heater assembly for an aerosol-generating system, comprising:

providing a flexible wick, applying tension to the wick, assembling a heating element around the wick, and releasing the tension from the wick.

Features described in relation to the first aspect may be applied to the second aspect. In particular a step of assembling the wick to a liquid storage portion, or a portion of a liquid storage portion, a step of connecting electrical contact elements to the heating element, and a step of crimping the heating element around the wick, may be performed while tension is applied to the wick.

The step of supplying tension to the wick may comprise holding the wick between two pairs of gripping elements.

Furthermore, features of the construction and assembly of the heating element, electrical contact portion or portions, liquid storage portion and cover described in relation to the first aspect may be applied to the second aspect, with the step of releasing tension from the wick taking the place of the step of the removal of the rigid support element, with the difference that the heating element is not assembled around a rigid support element but directly around the wick.

In a third aspect, there is provided a heater assembly manufactured in accordance with a method of the first or second aspect.

In all aspects, the capillary wick may have a fibrous or spongy structure. The capillary wick preferably comprises a bundle of capillaries. For example, the capillary wick may comprise a plurality of fibres or threads, or other fine bore tubes. The fibres or threads may be generally aligned in the longitudinal direction of the aerosol-generating system. Alternatively, the capillary wick may comprise sponge-like or foam-like material formed into a rod shape. The rod shape may extend along the longitudinal direction of the aerosol-generating system. The structure of the wick forms a plurality of small bores or tubes, through which the liquid can be transported to the electric heating element, by capillary action. The capillary wick may comprise any suitable material or combination of materials. Examples of suitable materials are ceramic- or graphite-based materials in the form of fibres or sintered powders. The capillary wick may have any suitable capillarity and porosity so as to be used with different liquid physical properties such as density, viscosity, surface tension and vapour pressure. The capillary properties of the wick, combined with the properties of the liquid, ensure that the wick is always wet in the heating area.

In all aspects, the heater assembly may comprise a single heating element. Alternatively, the heater assembly may comprise more than one heating element, for example two, or three, or four, or five, or six or more heating elements. The heating element or heating elements may be arranged appropriately so as to most effectively heat the aerosol-forming substrate.

The heating element preferably comprises an electrically resistive material. Examples of suitable metals include titanium, zirconium, tantalum and metals from the platinum group. Examples of suitable metal alloys include stainless steel. Constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation, 1999 Broadway Suite 4300, Denver Colo. In composite materials, the electrically resistive material may optionally be embedded in, encapsulated or coated with an insulating material or vice-versa, depending on the kinetics of energy transfer and the external physicochemical properties required. The heating element may comprise a metallic etched foil insulated between two layers of an inert material. In that case, the inert material may comprise Kapton®, all-polyimide or mica foil. Kapton® is a registered trade mark of E.I. du Pont de Nemours and Company, 1007 Market Street, Wilmington, Del. 19898, United States of America. The heating element may also comprise a metal foil, e.g., an aluminium foil, that is provided in the form of a ribbon. Alternatively, the metal foil may be printed on the wick material.

The liquid storage portion and cover portion may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

Preferably, the heater assembly is suitable for use in an aerosol-generating system that is portable. The aerosol-generating system may be a smoking system and may have a size comparable to a conventional cigar or cigarette. The smoking system may have a total length between approximately 30 mm and approximately 150 mm. The smoking system may have an external diameter between approximately 5 mm and approximately 30 mm.

Embodiments of the invention will now be described in detail, by way of example only, with reference to the accompanying drawings, in which:

FIGS. 7A to 7F illustrate alternative arrangements for providing rigidity to a length of wick during an assembly process.

Figure 1:
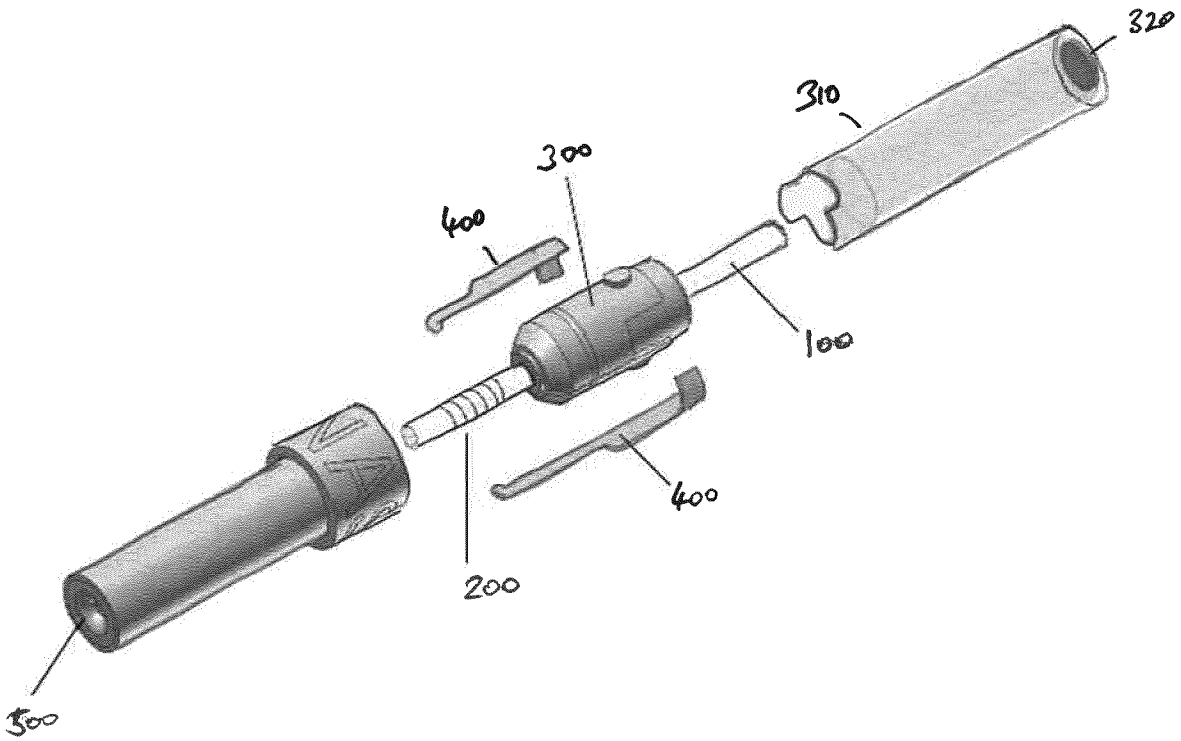
FIG. 1 is an exploded, perspective view of a heater assembly suitable for use in an aerosol-generating system.

FIG. 1 is an exploded view of a heater assembly. The heater assembly comprises a wick 100 and a heating element 200, in the form of a coil of electrically resistive filament, wrapped around the wick 100. The filament is formed from an electrically resistive metal or metal alloy. The wick 100 is fixed to a liquid storage portion which comprises a cap portion 300 and a main portion 310. FIG. 1 also shows a plug element 320 which is only required as a separate element to main portion 310 in some of the assembly methods which will be described. The heater assembly also includes electrical contact portions 400 to provide an electrical connection between the heating element 200 and external circuitry, including any power supply within the aerosol-generating device in which the heater assembly is to be used. The electrical contact portions 400 may be formed from any conductive material having low resistivity, e.g., gold plated metals and alloys, brass, and/or copper, and are shaped to fit within dedicated recesses in the cap portion 300.

A cover portion 500 is provided to extend over the heating element 200 and wick 100, and defines an aerosol-forming chamber in which liquid vaporised by the action of the heater 200 may condense to form an aerosol.

Figure 2:
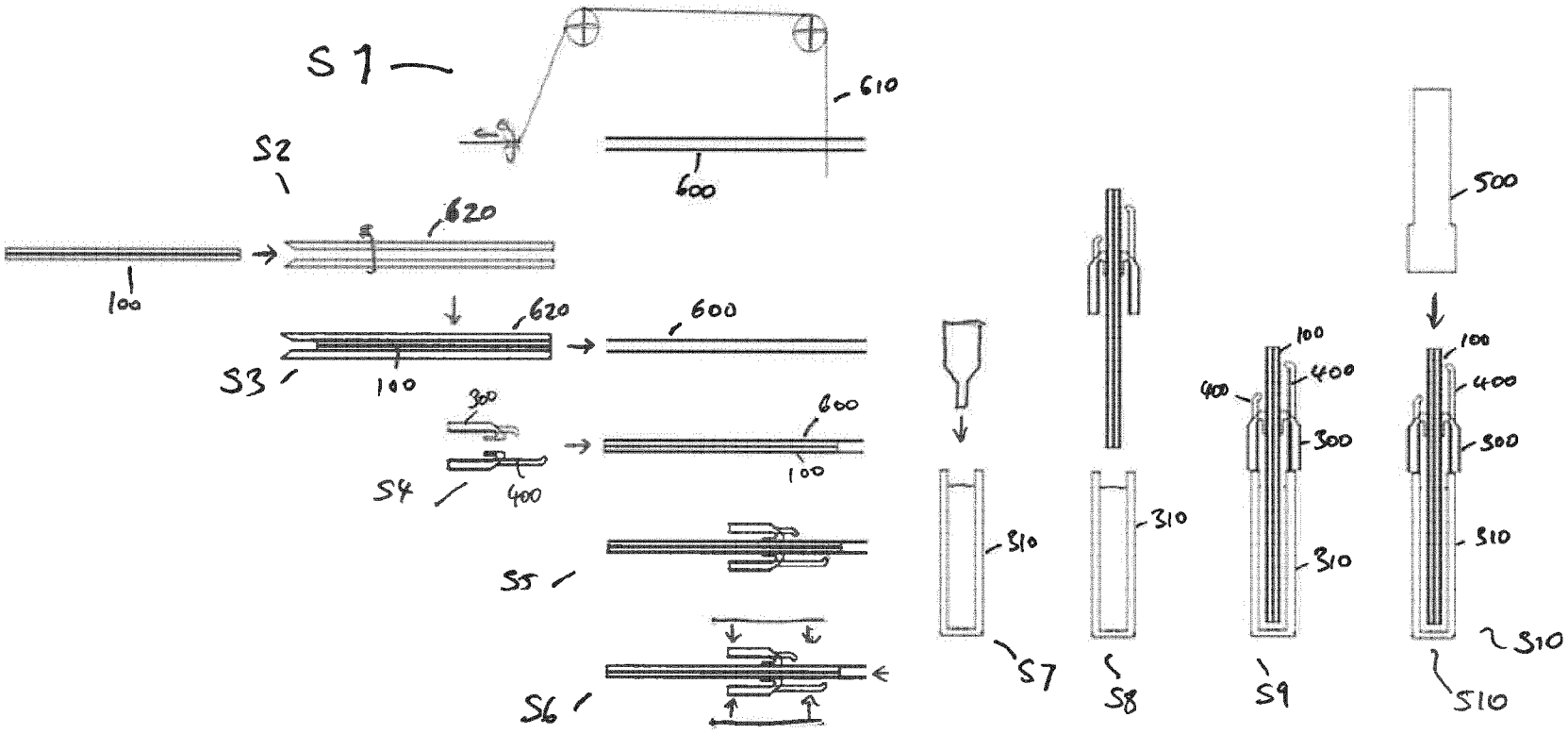
FIG. 2 is a schematic illustration of a first manufacturing process for assembling a heater assembly of the type shown in FIG. 1.

One particular difficulty with assembling a heater assembly of this type is the positioning of a heating element 200 around a flexible wick 100. FIG. 2 is a schematic illustration of a first manufacturing method for assembling a heater assembly of the type shown in FIG. 1. In the method of FIG. 2 the heating element is first constructed by winding a filament around a rigid tubular support which dimensioned so that it can receive a wick within its interior. The rigid tubular support may be formed from any rigid material having a slippery surface that does not impede the wick material from sliding off the support, for example, a stainless steel tube with or without a polished surface. This first step of winding the filament 610 around the rigid tubular support 600 is illustrated as S1. In a second step, S2, a wick 100 is cut to the required length. The wick 100 is loaded inside a rotary transfer tube 620, which may include a funnel portion. Once the wick is loaded inside the transfer tube, the wick is pushed into the rigid tubular support 600. This is shown as step S3. Following step S3 the cap portion 300 and electrical contact elements 400 are positioned around the tubular support 600. This is shown as step S4. In this embodiment the cap 300 and electrical contact elements 400 are all assembled to one another. In the subsequent step S5 the electrical contact portions 400 are fixed to the opposite ends of the heating element 200 by welding or crimping. Following assembly of the electrical contact portions to the heater, the rigid support element is preferably removed but may be kept in place to facilitate handling of the cap and contact assembly. This is achieved by pushing the wick out of the tubular support element 600 at the same time as withdrawing the tubular support element from the heating element 600 and the cap portion. This is shown as step S6.

Following this step, or simultaneously to this step, the main portion 310 of the liquid storage portion is filled with aerosol-forming substrate. This can be done using any conventional filling method. The sub-assembly of heater, wick and cap portion is then positioned relative to the main portion 310 of the liquid storage portion. This is shown as step S8. In step S9 the wick is inserted into the reservoir and the cap portion and main portion joined. The cap portion and main portion may be joined together using any suitable mechanism such as laser welding ultrasound technology, or mechanical locking. In a final step, S10, the cover portion 500 is loaded over the wick and fixed to the cap portion 300 using a mechanical locking engagement.

Figure 3:
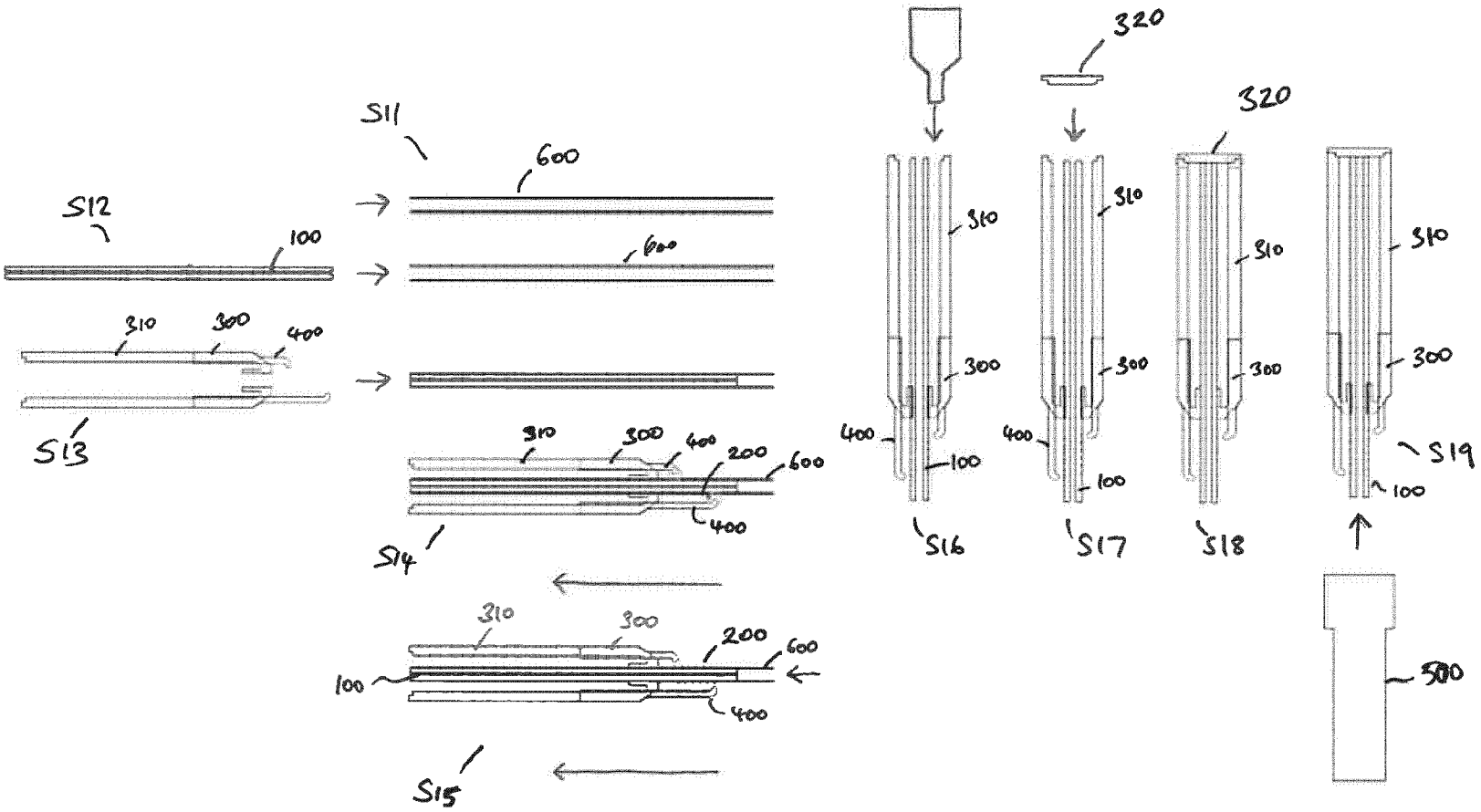
FIG. 3 is a schematic illustration of a second assembly process for manufacturing a heater assembly of the type shown in FIG. 1.

FIG. 3 illustrates an alternative manufacturing method to that shown in FIG. 2. In the method of FIG. 3, a rigid tubular support is used in the same manner as shown in FIG. 2. However, in the method of FIG. 3, the cap portion 300 and the main portion 310 of the liquid storage portion are pre-assembled and a plug element 320 is used to seal the liquid storage portion after filling. In a first step, S11, the heating element is assembled around the tubular support element 600 in the same manner as in step 1 illustrated in FIG. 2. In a second step, S12, a cut length of wick 100 is fed into the tubular support element 600. A rotary transfer tube may be used in the same manner as illustrated in FIG. 2. In a third step, S13, a pre-assembled sub-assembly of the main portion 310, cap portion 300 and electrical contact elements 400 are positioned around the tubular support element 600 so that the wick extends into the interior of the main portion 310. In a fourth step. S14, the electrical contact portions 400 are welded or crimped to the respective ends of the heating element 200. In a fifth step, the rigid support element 600 is removed. At the same time the wick 100 is pushed so as to prevent the wick being removed with the rigid tubular support 600.

In a sixth step, S16, the liquid storage portion is filled from its open rear end with the wick secured in position. In a seventh step, S17, the sealing plug 320 is placed over the open end of the main portion 310. In an eighth step, S18, the sealing plug is welded to the main portion 310 to ensure that the liquid storage portion does not leak. In a final step, S19, the cover portion 500 is fixed in position over the wick, in the same manner as described with reference to step S10 in FIG. 2.

It should be clear that in both of the methods described with reference to FIGS. 2 and 3 there may be additional steps performed. For example, between step S3 and S4, the heating element 200 may be crimped around the rigid support 600.

In both of the methods described with reference to FIGS. 2 and 3, the rigid support element 600 is dimensioned so that the wick is compressed when it is inside the rigid support element 600. When the rigid support element is removed from the wick, the wick will then expand to engage the heating element 200 and the cap portion 300.

Figure 4:
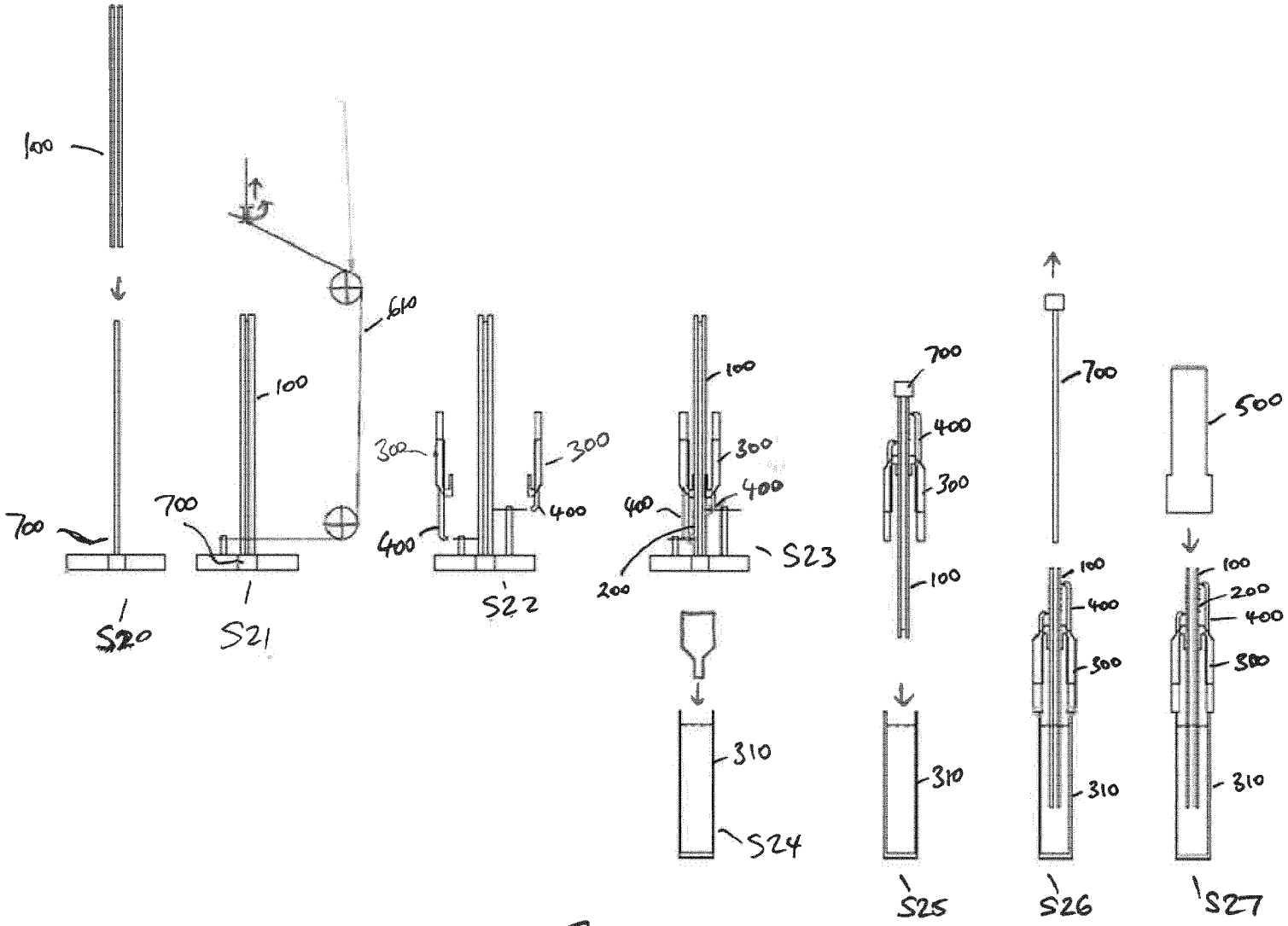
FIG. 4 is a schematic illustration of a third assembly process for manufacturing a heater assembly of the type shown in FIG. 1.

FIG. 4 illustrates a third manufacturing method for assembling a heater assembly of the type shown in FIG. 1. In first step, S20, the generally tubular wick 100 is loaded onto a rigid support fixture 700. The rigid support fixture 700 may be a stainless steel rod. In a second step, S21, a filament is wound around the wick 100 using a moving flyer assembly. The filament is fixed to a stationary point at one end. The flyer moves around the wick as well as moving parallel to the longitudinal axis of the wick to form a heating element in the shape of a coil 200. The filament 610 is tensioned during the winding of the coil using a tensioning device.

In a third step, S22, the cap portion 300 and electrical contact portions 400 are assembled around the wick 100. The cap portion is formed from two halves. Each half has an electrical contact portion 400 pre-assembled to it. The two halves of the cap portion are brought together around the wick and joined together. In a fourth step, S23, the electrical contact portions 400 are welded to the respective ends of the heating element.

In a fifth step, S24, which may be carried out in parallel with steps S20 to S23, the main portion 310 of the liquid storage portion is filled with aerosol-forming substrate. In a sixth step, S25, the sub-assembly of wick, heater, cap portion, and electrical contact portions is mounted to the main portion 310 with the wick extending into the liquid aerosol-forming substrate. In a seventh step, the supporting fixture 700 is removed from inside the wick. In an eighth step the cover portion 500, is assembled to the cap portion as previously described.

Figure 5:
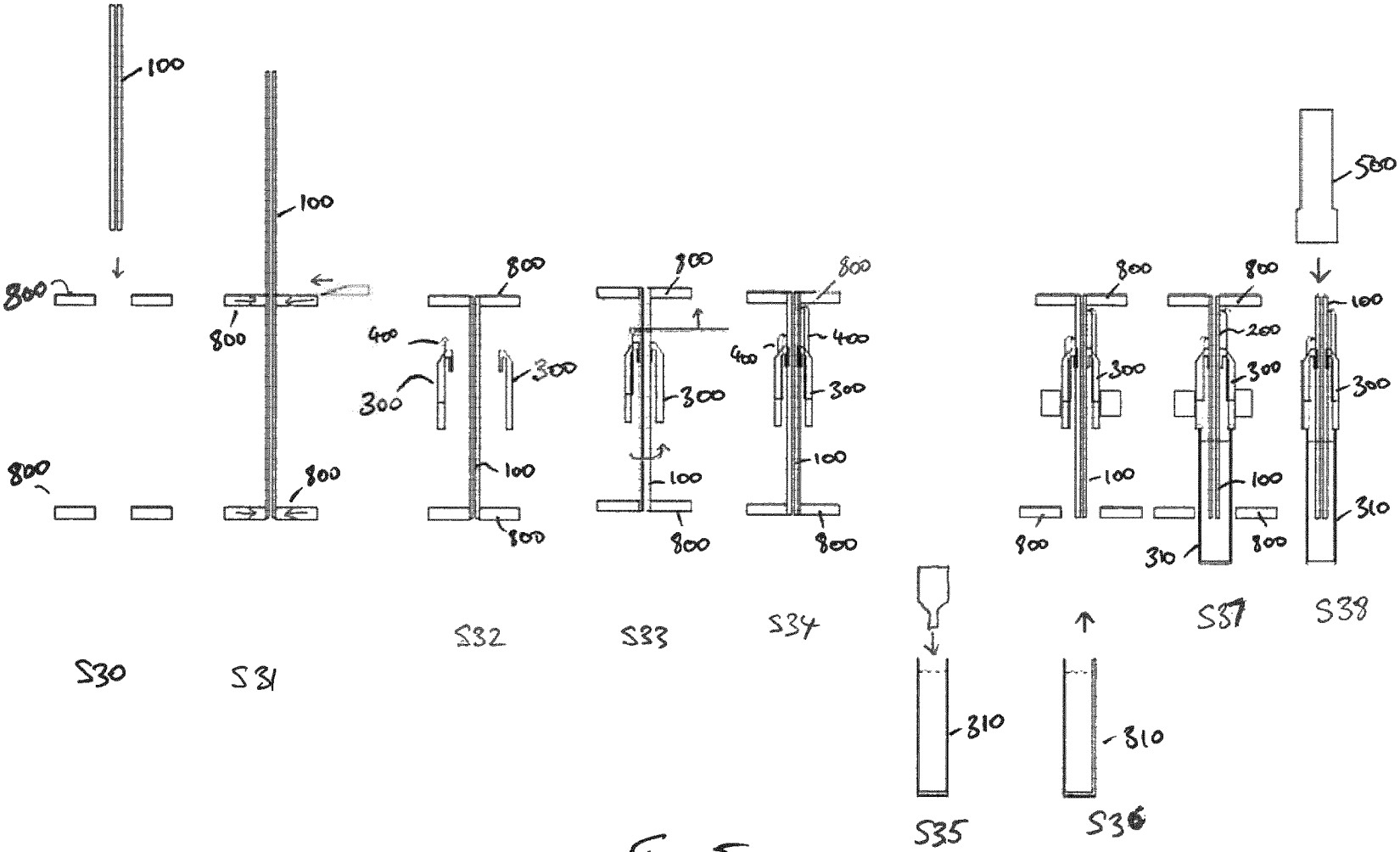
FIG. 5 is a schematic illustration of a fourth assembly process for manufacturing a heater assembly of the type shown in FIG. 1.

FIG. 5 is a schematic illustration of a fourth alternative assembly method for a heater assembly of the type shown in FIG. 1. The method of FIG. 5 relies on keeping the wick under tension to provide wick rigidity.

In a first step, S30, a length of wick 100 is fed between two pairs of grippers 800. In a second step, S31, the grippers 800 are clamped around the wick 100 and the wick then cut. In a third step, S32, the cap 300 and electrical contact element 400 are assembled around the wick. The cap portion 300 has only a single electrical contact element already in place. Once the cap portion has been assembled around the wick, the heater filament is crimped to the electrical contact element in step S33. The wick is also rotated at this point to wind the coil around itself. Following this step the second electrical contact element is loaded, in step S34, and is attached to the cap portion 300 and crimped to the heating element.

In a sixth step, S35, the main portion 310 of the liquid storage portion is filled with aerosol-forming substrate. In a seventh step, S36, the sub-assembly of wick, heater and cap portion is mounted to the filled main portion. In this step, the bottom pair of grippers 800 is released from the wick 100 to allow the free end of the wick to be inserted into the liquid aerosol-forming substrate. Advantageously, the cap portion 300 is held during this step of the process.

In an eighth step, the cap portion 300 is welded to the main portion 310 to provide a liquid tight liquid storage portion. In a final step, S38, the cover 500 is assembled over the wick 100, as previously described.

The methods described may be implemented in production line by moving the wick and heating element through a sequence of processing stages, corresponding to the steps described. The production line may be arranged on a rotary stage or along a conveyor.

Figure 6:
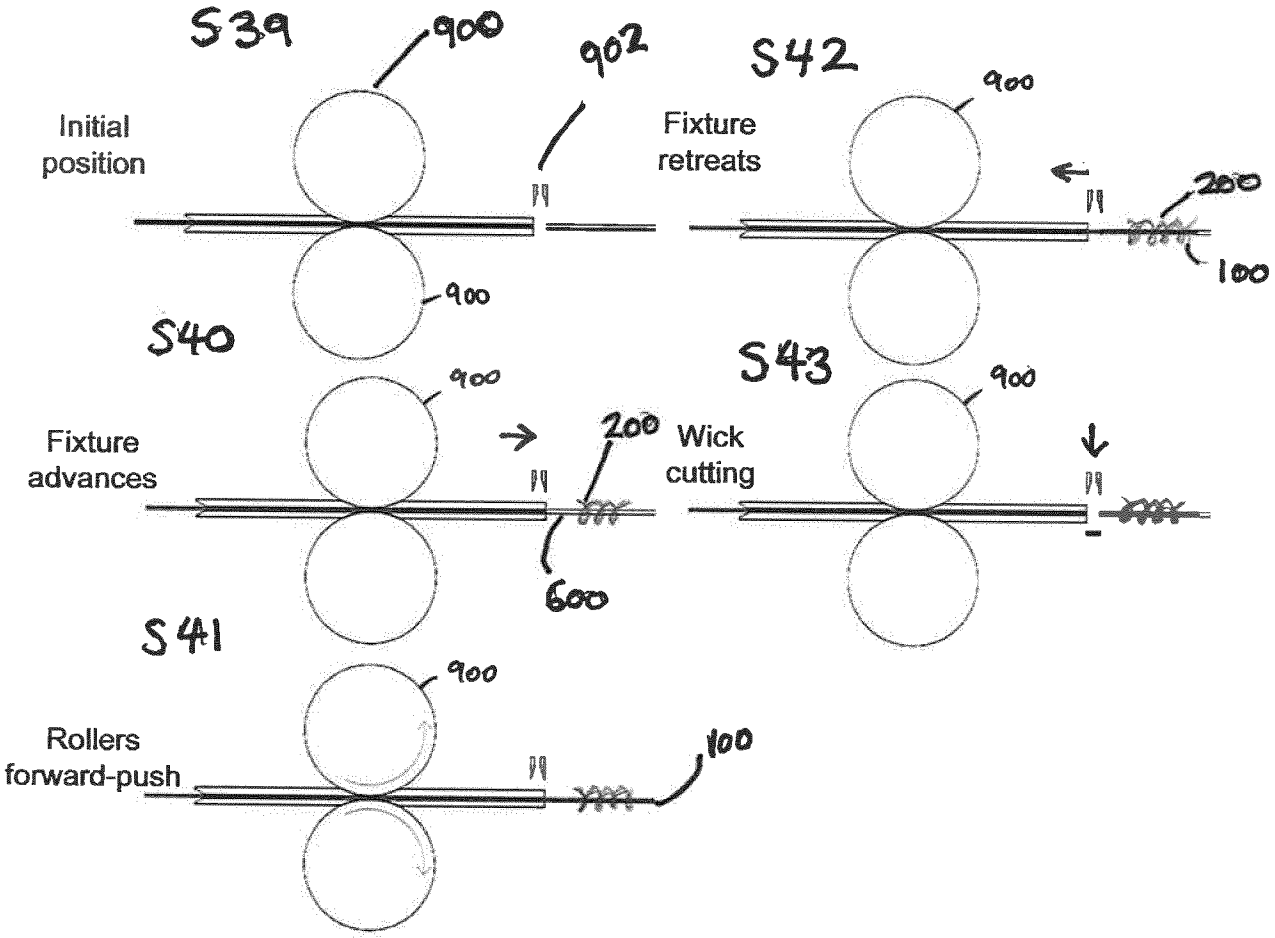
FIG. 6 illustrates an assembly line for handling the wick.

One exemplary set up of a production line is illustrated in FIG. 6. In FIG. 6, rollers 900 and cutting blades 902 are provided. The initial position of rigid tubular support 600 is shown in step S39. Moving to step S40, support 600 is advanced and heating element 200 formed around support 600. Next in step S41, rollers 900 push wick100 into the interior of support 600. In step S42, support 600 is retracted, leaving wick 100 surrounded by element 200. Cutting blades 902 then cut the assembled wick 100 with element 200 at a predetermined length in step S43.

It will now be clear to one of ordinary skill in the art that the above discussed manufacturing method is exemplary and that methods and apparatuses known in the art may be used to achieve desired results using the type of rigid support without deviating from the scope and spirit of the embodiments discussed herein.

Figure 7A:
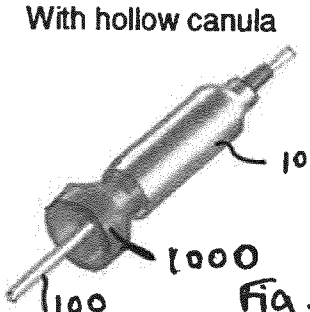
Figure 7B:
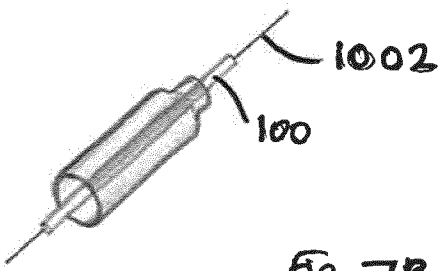
Figure 7D:
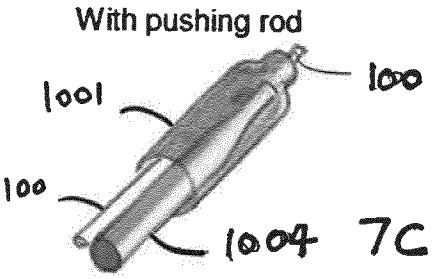
Figure 7D:
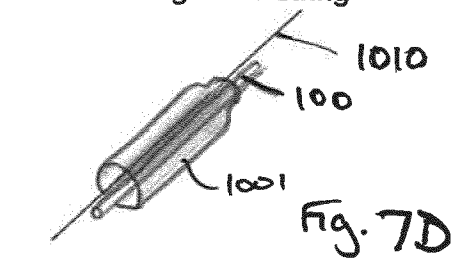
Figure 7E:
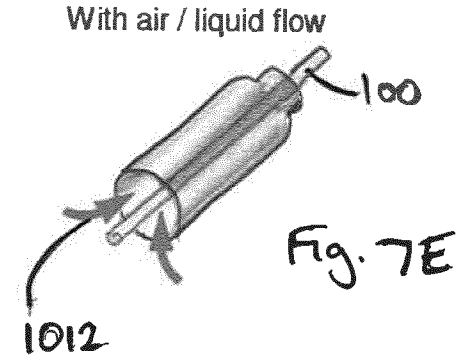
Figure 7F:
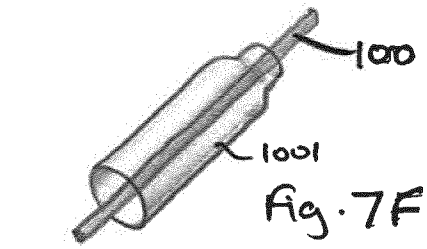

For example, although a rigid support may be used as discussed herein, variations on the use of a rigid support may be used instead. FIGS. 7A-7F illustrate such variations. FIG. 7A illustrates a hollow canula 1000 held within a funnel 1001 where wick 100 is pushed through the canula. FIG. 7B illustrates the use of an inner wire 1002 that provides sufficient rigidity to the wick material to facilitate wrapping of heater element 200 around the circumference of wick 100. FIG. 7C illustrates another possible solution, where a rigid rod 1004 provides support to the wick material by squeezing a first portion 1006 of wick 100 against funnel 1001 to provide sufficient rigidity to a second portion 1008 where element 200 is formed around. FIG. 7D illustrates an assisting wire 1010 provided along side of wick 100. Assisting wire 1010 may be withdrawn or kept with the completed wick 100 and element 200 assembly. Assisting wire 1010 may be formed of a wire or alternatively a string formed of a woven or other fibre. FIG. 7E illustrates another means of providing rigidity to the wick 100 prior to wrapping with element 200. In FIG. 7E, liquid 1012 is flowed through funnel 1001 over the wick 100 and the force of the flowing liquid provides sufficient rigidity to the wick 100 to be wrapped with element 200. Liquid 1012 may be any suitable liquid including forced air, so long as the liquid has sufficient density and may be provided at a sufficient flow rate to make wick 100 sufficiently rigid to wrap it with element 200. FIG. 7F illustrates the use of a frozen wick 100 where the wetting and freezing of liquid in wick 100 provides sufficient rigidity to wrap wick 100 with element 200.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. A method of manufacturing a heater assembly for an aerosol-generating system, comprising:

providing a flexible wick;

coupling a rigid support element to the flexible wick;

assembling an electrical heating element around the rigid support element; and removing the rigid support element;

wherein the rigid support element is a tubular element into which the flexible wick is insertable, and wherein the electrical heating element is first assembled around the tubular element, the flexible wick is subsequently inserted into the tubular element, and the tubular element is then removed from both the electrical heating element and the flexible wick.

2. The method of manufacturing a heater assembly according to claim 1, wherein the flexible wick and tubular element are dimensioned such that the flexible wick is compressed by the tubular element, so that the flexible wick expands when the tubular element is removed to contact the electrical heating element.

3. The method of manufacturing a heater assembly according to claim 1, wherein the heater assembly comprises a liquid storage portion containing or adapted to contain a liquid aerosol-forming substrate, and wherein the flexible wick is assembled to the liquid storage portion, or a part of the liquid storage portion, before the step of removing the rigid support element.

4. The method of manufacturing a heater assembly according to claim 3, wherein the liquid storage portion comprises a main portion and a cap portion, the method further comprising assembling the main portion and the cap portion together after the main portion has been filled with the liquid aerosol-forming substrate.

5. The method of manufacturing a heater assembly according to claim 4, further comprising assembling the flexible wick to the cap portion before the rigid support element is removed.

6. The method of manufacturing a heater assembly according to claim 4, wherein the cap portion comprises a plurality of pieces, the method further comprising the step of joining the plurality of pieces together around the flexible wick.

7. The method of manufacturing a heater assembly according to claim 3, wherein the heater assembly further comprises one or more electrical contact elements that are connected to the electrical heating element to provide, in use, an electrical connection between the electrical heating element and external circuitry, further comprising mounting the electrical contact element or elements to the liquid storage portion before connecting the one or more electrical contact elements to the electrical heating element.

8. The method of manufacturing a heater assembly according to claim 7, further comprising mounting the one or more electrical contact elements to a portion of the liquid storage portion, before said portion is fixed relative to the flexible wick.

9. The method of manufacturing a heater assembly according to claim 1, wherein the electrical heating element is a coil of electrically resistive wire.

10. The method of manufacturing a heater assembly according to claim 9, wherein the electrically resistive wire is wound around the rigid support element.

11. The method of manufacturing a heater assembly according to claim 9, further comprising a step of pressing or crimping the coil of electrically resistive wire against the flexible wick or the rigid support element in a pressing or crimping operation.

12. The method of manufacturing a heater assembly according to claim 11, wherein the pressing or crimping operation is performed before removing the rigid support element.

13. A heater assembly manufactured in accordance with a method of claim 1.

* * * * *